US010270177B2

(12) United States Patent
Lindmark

(10) Patent No.: US 10,270,177 B2
(45) Date of Patent: Apr. 23, 2019

(54) BROADBAND ANTENNA, MULTIBAND ANTENNA UNIT AND ANTENNA ARRAY

(71) Applicant: Filtronic Wireless AB, Taby (SE)

(72) Inventor: Bjorn Lindmark, Taby (SE)

(73) Assignee: Filtronic Wireless AB, Täby (SE)

( * ) Notice: Subject to any disclaimer, the term of this patent is extended or adjusted under 35 U.S.C. 154(b) by 0 days.

(21) Appl. No.: 15/978,211

(22) Filed: May 14, 2018

(65) Prior Publication Data

US 2018/0294574 A1 Oct. 11, 2018

Related U.S. Application Data

(63) Continuation of application No. 15/183,396, filed on Jun. 15, 2016, now Pat. No. 9,972,910, which is a (Continued)

(30) Foreign Application Priority Data

Feb. 18, 2014 (GB) ..... 1402882.3

(51) Int. Cl.
*H01Q 13/10* (2006.01)
*H01Q 21/08* (2006.01)
(Continued)

(52) U.S. Cl.
CPC ..... *H01Q 13/10* (2013.01); *H01Q 21/08* (2013.01); *H01Q 21/24* (2013.01); *H01Q 21/28* (2013.01)

(58) Field of Classification Search
CPC ..... H01Q 13/10; H01Q 21/08; H01Q 21/24; H01Q 21/28
See application file for complete search history.

(56) References Cited

U.S. PATENT DOCUMENTS 4,672,386 A * 6/1987 Wood ..... H01Q 21/24 343/770
6,930,650 B2 8/2005 Gotti
(Continued)

FOREIGN PATENT DOCUMENTS

DE 102010011867 A1 9/2011
EP 0149922 A2 7/1985
(Continued)

OTHER PUBLICATIONS

International Search Report and Written Opinion dated May 8, 2015 in Application No. PCT/EP2015/05322.

*Primary Examiner* — Hoang V Nguyen
(74) *Attorney, Agent, or Firm* — AWA Sweden AB; Thomas L. Ewing

(57) ABSTRACT

A broadband antenna of an antenna system comprises a conductive plate comprising four slots. The slots are arranged in a rotation symmetrical manner in the plate. Each slot extends from a circumference of the plate towards a center of the plate. Each slot has an associated feed point located at its associated slot. The feed points associated with a pair of oppositely arranged slots are arranged to be fed with radio frequency signals, such that that a main radiation propagation direction of the antenna is along the rotational symmetry axis of the plate. The antenna design enables the achievement of flexibility in terms of isolation between the two polarizations. The antenna design may further enable a reduced size and weight. The antenna design also enables an antenna unit and an antenna array.

22 Claims, 7 Drawing Sheets

Related U.S. Application Data continuation of application No. PCT/EP2015/053322, filed on Feb. 17, 2015.

(51) Int. Cl.
*H01Q 21/24* (2006.01)
*H01Q 21/28* (2006.01)

(56) References Cited

U.S. PATENT DOCUMENTS

| | | | | |
|---|---|---|---|---|
| 7,298,228 | B2 * | 11/2007 | Sievenpiper | H01P 1/10 333/101 |
| 2006/0114168 | A1 | 6/2006 | Gotti et al. | |
| 2012/0139806 | A1 | 6/2012 | Zhan | |
| 2013/0009834 | A1 | 1/2013 | Hefele et al. | |
| 2013/0141296 | A1 | 6/2013 | Jaffri et al. | |
| 2015/0229026 | A1 | 8/2015 | Lindmark | |

FOREIGN PATENT DOCUMENTS

| | | | |
|---|---|---|---|
| EP | 1267446 | A1 | 12/2002 |
| EP | 1494316 | A1 | 1/2005 |
| EP | 2907197 | | 8/2015 |
| EP | 3028342 | | 5/2016 |
| GB | 2523201 | | 8/2015 |
| JP | H07111418 | | 4/1995 |
| JP | 2013066094 | | 4/2013 |
| SE | 536697 | | 4/2014 |
| WO | 2014/062513 | | 4/2014 |
| WO | 2015/124573 | | 8/2015 |

* cited by examiner

BROADBAND ANTENNA, MULTIBAND ANTENNA UNIT AND ANTENNA ARRAY

RELATED APPLICATIONS

The present application is a continuation application of U.S. patent application Ser. No. 15/183,396, entitled "Broadband Antenna, Multiband Antenna Unit and Antenna Array," now U.S. Pat. No. 9,972,910 (issued May 15, 2018), which itself is a continuation of International Patent Application Serial No. PCT/EP15/53322, filed on Feb. 17, 2015, which claims priority benefit to United Kingdom Patent Application No. 1402882.3, filed on Feb. 18, 2014. The disclosures of the foregoing applications are incorporated herein by reference in their entireties.

FIELD OF THE INVENTION

Embodiments of the present invention generally relate to the field of broadband antennas.

BACKGROUND

Multiband broadband antenna systems are antenna systems providing wireless signals in multiple radio frequency bands. They are commonly used in wireless communication systems, such as GSM. GPRS, EDGE, UMTS, LTE, and WiMax systems.

These types of antenna systems generally include a plurality of radiating antenna elements arranged to provide a desired radiated, and received, signal beamwidth and azimuth scan angle.

For broadband antennas it is desirable to achieve a near-uniform beamwidth exhibiting minimum variation over desired azimuthal degrees of coverage. Such broadband antennas generally provide equal signal coverage over a wide geographic area while simultaneously supporting multiple wireless applications. Preferably, the beamwidth is consistent over a wide frequency bandwidth in modern wireless applications since transmission to and reception from mobile stations use different frequencies. It is also desirable to have a common footprint for different wireless services using a common antenna arrangement.

Document U.S. Pat. No. 6,930,650 (Göttl et al.) discloses a dual-polarized antenna arrangement having four antenna element devices each with a conductive structure between opposite antenna element ends. The antenna element devices are fed at the respective end of the four gaps.

Document U.S. Pat. No. 7,079,083 (Göttl et al.) discloses a multiband mobile radio antenna arrangement comprising multiple dipole elements arranged in front of a reflector and adapted to transmit and receive in two different frequency bands. The antenna element for the higher frequency band is at a specified distance from the reflector.

Document US20130009834 (Hefele et al.) relates to a dual-polarized antenna comprising a horizontally polarized radiating element and a vertically polarized radiating element.

Document JP H07111418 (Matsushita) discloses a planar ring patch antenna provided with notches.

The above described references disclose complicated mechanical structures that require high complexity die-cast metal parts and therefore have considerable weight. The disclosed antenna elements are also cumbersome due to its height and overall large size.

SUMMARY OF THE INVENTION

It would be advantageous to achieve a broadband antenna overcoming, or at least alleviating, the above mentioned drawbacks. In particular, it would be desirable to enable an antenna with reduced size and maintained, or even improved, impedance characteristics.

To better address one or more of these concerns, a broadband antenna having the features defined in the independent claim is provided. Preferable embodiments are defined in the dependent claims.

Hence, according to an aspect, a broadband antenna for an antenna system is provided. The antenna comprises a conductive plate comprising four slots. The slots are arranged in a rotation symmetrical manner in the plate. Each slot extends from a circumference, or perimeter, of the plate, towards a rotational symmetry center of the plate. Each slot has an associated feed point located at its associated slot.

The feed points associated with a pair of oppositely arranged slots are may e.g. be arranged to be fed with radio frequency signals, having a same phase such that that a main radiation propagation direction of the antenna is along the rotational symmetry axis of the plate. This is advantageous over prior art such as e.g. US20130009834 and JP H07111418, wherein the slots or notches are fed in phase (or with a phase difference of 180° ) such that the horizontally polarized radiation has a maximum in or near the horizontal plane and with a null on the rotational symmetry axis.

Placing the four slots in a rotation symmetrical manner enables one slot, of the pairs of oppositely arranged slots, to be fed such that the interfering effect of the electric field from one slot pair upon the other slot pair may be adjusted and/or reduced. In other words, the antenna design enables the achievement of flexibility in terms of isolation between the two polarizations. The antenna design may further enable a reduced size and reduced weight.

By arranging oppositely arranged slots in the same conductive plate or, in other words, in a single conductive plate, a dual-polarized antenna may be achieved.

According to an embodiment the feed points associated with two pairs of oppositely arranged slots are further arranged to be fed with radio frequency signals having a same phase.

By placing the four slots in a rotation symmetrical manner, the electric field strength originating from one of the pairs of oppositely arranged slots, when fed with a phase equal to that of the phase fed to another pair, may be reduced approximately where the slots of the other pair of the pairs of oppositely arranged slots, are arranged. Thereby, the interfering effect of the electric field from one slot pair upon the other slot pair may be reduced. In other words, the isolation between the two polarizations may be increased.

According to an embodiment the feed points associated with two pairs of oppositely arranged slots are further arranged to be fed with radio frequency signals having a same amplitude.

By placing the four slots in a rotation symmetrical manner, the electric field strength originating from one of the pairs of oppositely arranged slots, when fed with an amplitude equal to that of the amplitude fed to another pair, may be reduced approximately where the slots of the other pair of the pairs of oppositely arranged slots, are arranged, Thereby, the interfering effect of the electric field from one slot pair upon the other slot pair may be reduced. In other words, the isolation between the two polarizations may be increased.

According to an embodiment, the circumference may be located at a first distance from the rotational symmetry center, each feed point may be located at a second distance from the rotational symmetry center, and the second distance may be less than said first distance. In other words, the feed points are not arranged at the immediate circumference. Arranging the feeding termination point at a location separate from that of the circumference enables increased adjustability of the impedance. The first distance represents a theoretical maximum slot length. The total length of a slot affects the frequency of operation of the antenna.

According to an embodiment, the second distance is less than 0.5 times the first distance. A second distance-first distance ratio is proportional to the real-part of the impedance of the slot, i.e. the resistance of the slot. This property can be used to achieve a desired active impedance.

According to an embodiment, each slot ends at a fourth distance from the rotational symmetry center. The fourth distance is less than the second distance, such that the slot length is the first distance minus the fourth distance. In other words, each feeding termination point is located somewhere along the slot.

According to an embodiment, each slot has a widening shaped symmetrically with respect to the longitudinal extension of the slot, starting from a third distance from, and extending towards, the rotational symmetry center of the plate. The third distance is less than the second distance, whereby the feed point is arranged further away from the rotational symmetry center than the widening. This enables increased effective slot length, which may be advantageous where it is not possible to extend the slots all the way in to the rotational symmetry center of the plate. This may further enable maintaining the location of the feed point, while extending the effective length of the slot.

According to an embodiment, the broadband antenna further comprises a support structure for spacing said antenna from a reflector structure. The size of the spacing may be selected so as to improve the antenna performance.

The support structure may comprise, in its interior, at least one channel extending at least in part along the rotational axis. The channel may be arranged to hold guiding means for antenna feed termination points.

The feeding of the slot pairs described above will lead to zero, or near zero, vertical, i.e. z-directed, electric field on this symmetry axis. Therefore, the support structure may have negligible effect on the performance of the antenna.

According to an embodiment, the antenna comprises four feeding termination points, arranged on the plate. Each feeding termination point may be arranged to obtain one of the feed points. The antenna may further comprise four guiding means. Each guiding means is arranged to feed one of the feeding termination points with the radio frequency signal.

According to an embodiment, each guiding means comprises a microstrip line or a coaxial cable. The characteristic impedance of the microstrip lines or coaxial cables comprised in the guiding means may be chosen such that it reduces the wave reflection at the junction between the guiding means and the main coaxial transmission line.

According to an embodiment, the antenna is arranged to radiate radio frequency signals in two orthogonal polarizations, thereby advantageously achieving diversity that does not require further antenna spacing.

According to an embodiment, the circumference of the plate is shaped in a rotation symmetrical manner. In other words, the shape of a portion of the edge of the plate is repeated along the circumference in a rotation symmetrical manner.

According to an embodiment, the plate is circular.

According to an embodiment, an edge of the plate has concave cut-outs extending towards the rotational symmetry center of the plate. Each cut-out may be arranged between two neighboring slots. Hence, the cut-outs are arranged alternatingly with the slots, preferably in a rotational symmetrical manner. The term cut-out should not be interpreted as limiting to recesses accomplished in the circumference through actual cutting or other metal working, but merely as a term descriptive of the shape of the plate. This shape enables a reduced width of the plate between two opposite cut-outs, thereby enabling arranging an increased number of antennas per running meter of an antenna array, with maintained slot length of the antennas.

According to an embodiment, a resulting polarization from a first pair of oppositely arranged slots may differ from a resulting polarization from a second pair of oppositely arranged slots. In particular, the respective polarizations may be orthogonal with respect to each other.

In particular, the respective resulting polarizations along the main radiation propagation direction may be orthogonal with respect to each other, According to an embodiment, a multiband antenna unit is provided. The multiband antenna unit comprises at least one first broadband antenna according to any one of the preceding embodiments and at least one second broadband antenna arranged above or below the first broadband antenna. The multiband antenna unit may further comprise at least one planar parasitic element arranged between the first and second broadband antennas. The presence and positioning of the parasitic element may affect the impedances and the radiation patterns of the first and/or the second broadband antennas. Specifically, the parasitic element may affect the impedance of the lower antenna and at the same time the radiation pattern of the upper antenna, as the parasitic element may act as a reflector for the upper antenna element.

According to an embodiment, the parasitic element comprises a planar portion arranged in parallel with the plate comprised in the lower broadband antenna, and has a quadratic shape. The parasitic element may further have sidewalls protruding upwards in the main radiation propagation direction of the multiband antenna unit.

The proportions between a width of the quadratic shape of the parasitic element and a height of the sidewalls may be chosen so as to achieve a desired azimuth beamwidth to be radiated from the upper antenna element.

According to an embodiment the width of the quadratic shape of the parasitic element is larger than ⅕ but less than ⅓ of a wavelength corresponding to a center operation frequency for the lower broadband antenna. Said width can be chosen so as to affect the impedance match of for the second antenna favorably.

According to an embodiment the upper broadband antenna is arranged to radiate radio signals in a first frequency band and the lower broadband antenna is arranged to radiate radio signals in a second frequency band, the center operation frequency of said first frequency band being higher than the center operation frequency of said second frequency band.

The combination of two broadband antennas into one multiband antenna unit enables the combined utilization of two immediately adjacent frequency bands virtually operating as one frequency band with a bandwidth corresponding to the sum of first and second frequency bands' bandwidth.

According an to embodiment an antenna array is provided. The antenna array comprises a plurality of broadband antennas as defined in any of the preceding embodiments.

According to embodiments the antenna array may comprise a plurality of multiband antenna units according to the invention and a plurality of broadband antennas according to the invention. The multiband antenna units and the broadband antennas may be alternately arranged in a row so that a distance between the center of a first antenna element and an adjacent antenna unit in said row is constant.

Embodiments provide an antenna having a planar plate that enables the manufacturer to use printed circuit boards, PCBs, for the feed network, which is convenient from a matching point of view. Also, the active impedance, i.e. the impedance seen when two slots of the same polarization are excited simultaneously in phase and of equal magnitude, of each slot can be tuned to 100 ohm impedance which allows an easy match of the two feeds to a common 50 ohm transmission line when providing broadband operation in two orthogonal polarizations.

The present broadband antenna, multiband antenna and antenna array may also be made small in size which reduces the necessary total volume and weight of antenna installations in the field.

It is noted that embodiments of the invention relate to all possible combinations of features recited in the claims.

BRIEF DESCRIPTION OF THE DRAWINGS

This and other aspects will now be described in more detail in the following illustrative and non-limiting detailed description of embodiments, with reference to the appended drawings.

The appended drawings are intended to clarify and explain different embodiments of the present invention in which.

All the figures are schematic, not necessarily to scale, and generally only show parts which are necessary in order to elucidate the embodiments, wherein other parts may be omitted. Like reference numerals refer to like elements throughout the description.

DETAILED DESCRIPTION OF AN EMBODIMENT OF THE INVENTION

Figure 1A:
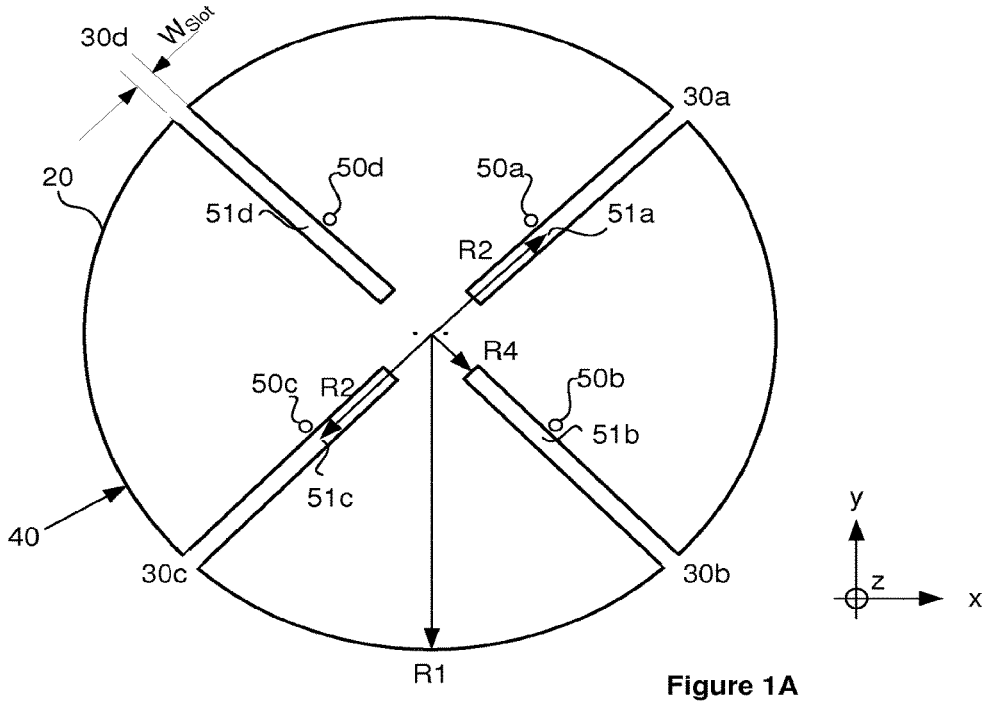
FIG. 1A-1D show the respective plates comprised in four different embodiments of an antenna element 10 according to the present invention.
Figure 1B:
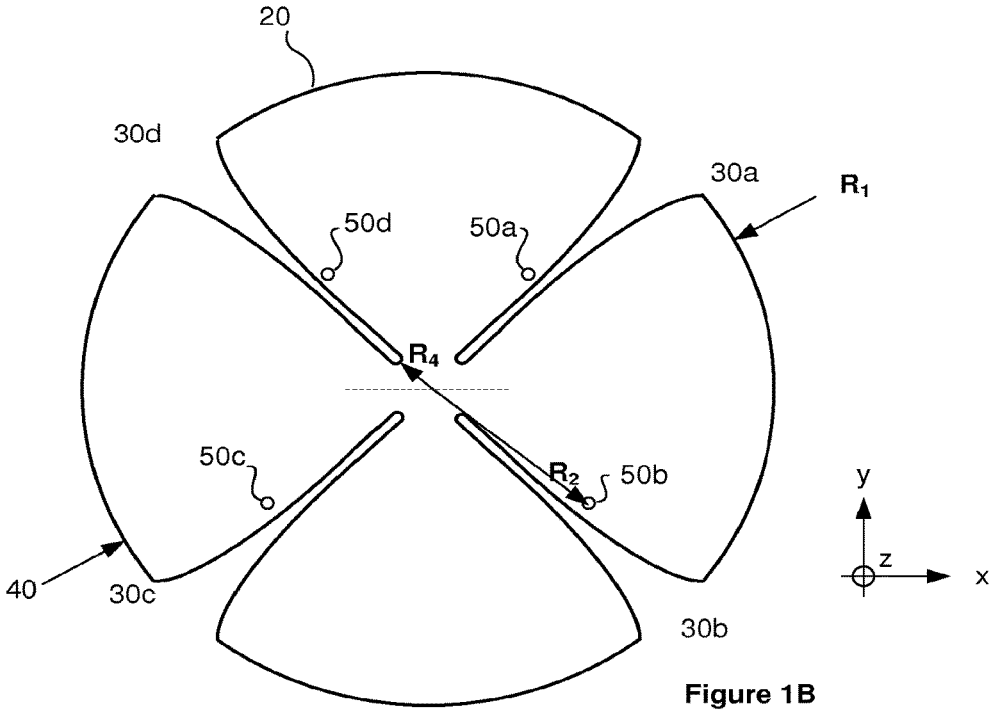
Figure 1C:
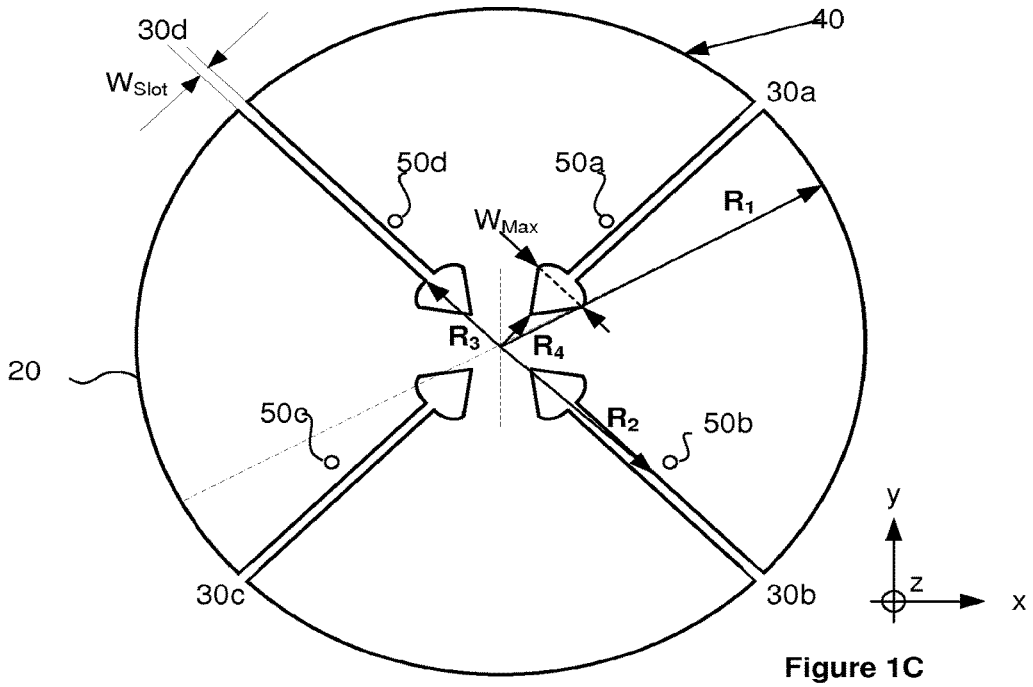
Figure 1D:
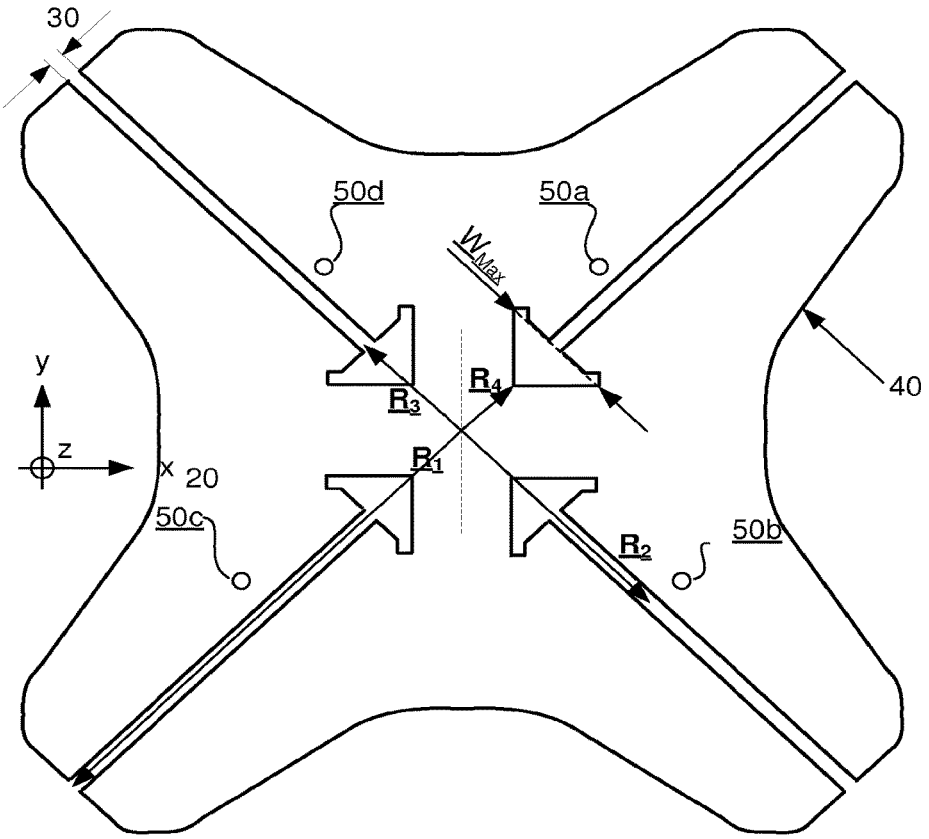

A broadband antenna 10 according to an embodiment will be described with reference to FIG. 2. The broadband antenna may interchangeably be referred to as broadband antenna element 10.

The broadband antenna comprises a conductive plate 20 comprising four slots 30*a*, 30*b*, 30*c*, 30*d*. The slots are arranged in a rotation symmetrical manner in the plate.

Each slot extends from a circumference 40, or perimeter 40, of the plate 20, which, for the purpose of this specification may be alternately referred to as a disc 20, towards a rotational symmetry center of the plate 20. Each slot 30*a*, 30*b*, 30*c*, 30*d* has an associated feed point 51*a*, 51*b*, 51*c*, 51*d* located at its associated slot.

The feed points associated with e.g. the pair 30*a*, 30*c* of oppositely arranged slots are arranged to be fed such that a main radiation propagation direction of the antenna is along the rotational symmetry axis of the plate 20.

By placing the four slots in a rotation symmetrical manner, the electric field strength originating from one of the pairs of oppositely arranged slots, when fed with equal phase, may be reduced approximately where the slots of the other pair are arranged. Thereby, the interfering effect of the electric field from one slot pair upon the other slot pair may be reduced. In other words, the isolation between the two polarizations may be increased.

Even when the radio frequency signal fed to the first one of the pairs of oppositely arranged slots is only approximately equal to the phase of the radio frequency signal fed to the second one of the pairs of oppositely arranged slots, the isolation effect may be improved.

As an example, a deviation of as much as 10 degrees between the phases may be tolerated.

In a similar fashion, the electric field strength originating from one of the pairs of oppositely arranged slots, when fed with equal amplitude, presents a minimum approximately where the slots of the other pair are arranged.

Even when the radio frequency signal fed to the first one of the pairs of oppositely arranged slots is only approximately equal to the phase of the radio frequency signal fed to the second one of the pairs of oppositely arranged slots, the isolation effect may be improved.

In embodiments where both phase and amplitude are approximately equal, the electric field strength originating from one of the pairs of oppositely arranged slots, when fed, presents a minimum where the slots of the other pair are arranged, such that the interfering effect is, for practical purposes, virtually absent.

The plate may be circular or rotational symmetric in some other fashion.

Figure 2:
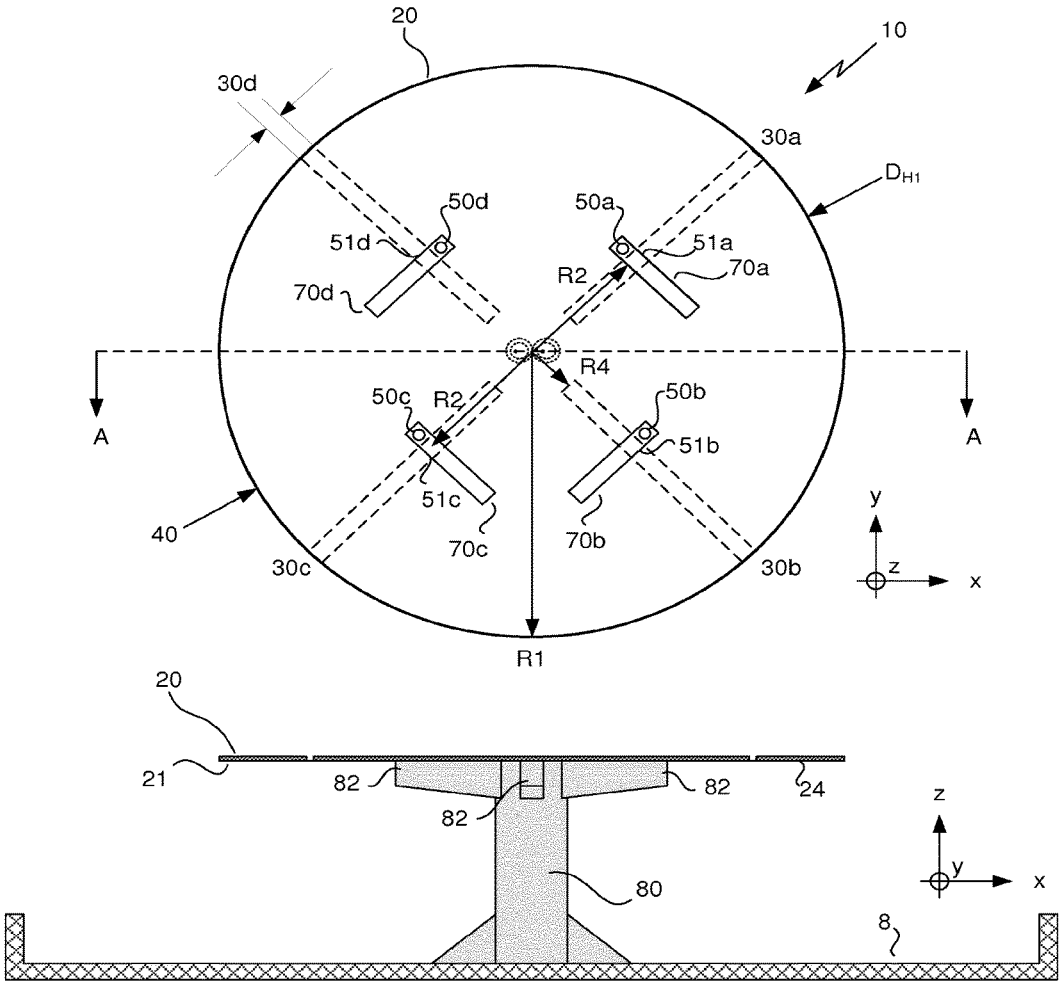
FIG. 2 shows top and side views of a single band broadband frequency coverage antenna element according to an embodiment of the invention.

FIG. 2 further shows two oppositely arranged feed point pairs 51*a*-51*c* and 51*b*-51*d* associated with feeding termination points 50*a*, 50*c* and 50*b*, 50*d*, respectively.

As is well known to those skilled in the art, an antenna with multiple feed points will have an active impedance, also known as driving point impedance. For example, considering a first slot, 30*a*, and a second slot, 30*c*, of the antenna element: if mentioned slots are excited with the same phase and magnitude we will have radiation along the rotational symmetry axis. In order to match the antenna to a desired impedance, it is important to consider the mutual coupling between the first and second slots. The relevant impedance is then referred to as active or driving point impedance calculated as follows:

If the impedances of slots 30*a* and 30*c* are Zaa and Zcc, respectively, and the mutual impedance is Zac=Zca, the active impedance, also called driving point impedance, of slot 30*a*, given feed currents Ia and Ic, exciting slots 30*a* and 30*c* respectively, is:

Za, driving point=Zaa+Zac*Ic/Ia. When Ia=Ic, e.g. with equal phase and magnitude, the active impedance is simply: Za, driving point=Zaa+Zac.

As illustrated e.g. by FIG. 1, the circumference 40 of the disc 20 is located at a first distance R1 from the rotational axis, and each feed point is located at a second distance R2 from the rotational symmetry axis. The relation between the first and second distances is such that the second distance R2 is less than the first distance R1, i.e. R2<R1. Preferably, the second distance R2 is less than 0.5 times the first distance R1, i.e. R2<0.5 R1. A smaller R2 provides a smaller real part, smaller resistance, of the slot impedance. This can be used to achieve the desired active impedance.

Moreover, according to another embodiment, each slot 30*a*, 30*b*, 30*c*, 30*d* extends inwards, and ends at a fourth distance R4 from the rotational symmetry axis of the disc 20 (see FIG. 1A-1D), wherein the fourth distance R4 is less than the second distance R2, i.e. R4<R2. An antenna element used by the inventors had the following setup: R1=32 mm, R2=13 mm, R4=6.5 mm for operation in the frequency band 1710-2690 MHz.

Generally, the total length of the slots, i.e. R1-R4, affects the frequency of operation of the radiating antenna element 10. For example, for operation in the frequency band from 1710 MHz to 2690 MHz, a suitable length of the slots is 20 to 35 mm which corresponds to 0.15 to 0.25 wavelengths at the center frequency for 2200 MHz.

The slot, which is illustrated as having a constant slot width e.g. in FIG. 1A and FIG. 2, may be designed to match the antenna impedance. A wider slot increases the reactance of the antenna element, hence making it more inductive, while a narrower slot will make it more capacitive.

It is also possible to use varying slot width all the way to the circumference of the disc, e.g. exponential slot width taper, linear step taper or linear slope taper.

Further, each slot may have a symmetrically shaped widening 60. Each such widening may start from a third distance R3 from the rotational symmetry axis and extend inwards towards the rotational symmetry center of the disc. Each widening should start from a third distance R3 from the rotational symmetry center that is less than the second distance R2 which defines the location of the feeding termination points. Depending on the magnitude of the distance R1 of the disc and the position of the transmission lines 31, 32 from the feed network it may be impossible to extend the slots as far to the rotational symmetry center of the disc as desired from an antenna impedance point of view. It may then be preferable to increase the effective length of the slots by making them wider at the inner end closest to the rotational symmetry center of the disc. Hence, according to yet another embodiment each widening 60 has a largest width WMax that is cslot times the width of each slot, where cslot is a constant. In one embodiment the slots have a minimum width WSlot.

FIG. 1A-1D show the plate 20 of different embodiments of an antenna element 10. It is noted that the disc 20 in this case has four symmetrically arranged slots, each slot with an associated widening 60 which is pointed in shape in the radial inwards direction.

This allows maintaining of the slot feed at the feed point while extending the effective length of the slot.

Figure 3:
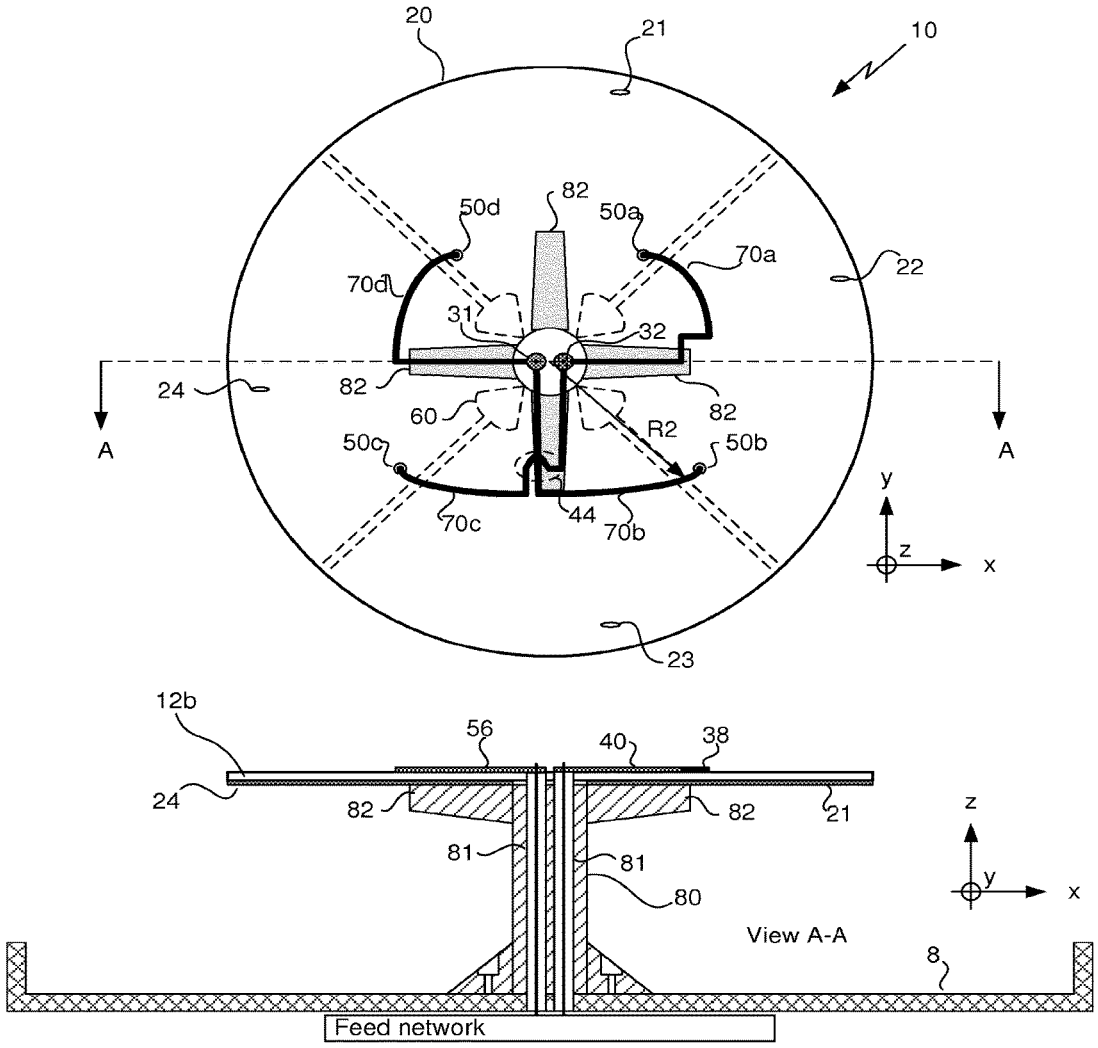
FIG. 3 shows top and side views of an antenna element according to another embodiment of the present invention.

FIGS. 2 and 3 show different embodiments of a single frequency antenna element with associated support structures 80. With reference to FIG. 2 the antenna element has a conductive disc 20 positioned above a conducting reflector 8 by means of a support structure 80. The support structure 80 is, in this embodiment, symmetrically arranged around, and extends along, the rotational symmetry axis of the plate and is arranged to support the antenna element 10 with a predetermined distance over the reflector 8 associated with the antenna element 10. As well known by those skilled in the art, the feeding of the slot pairs described above will lead to zero, or near zero, vertical, i.e. z-directed, electric field on this symmetry axis. Therefore, the support has negligible effect on the antenna.

Optionally, the support structure 80 may have in its interior one or more channels 81 extending at least in part along the rotational symmetry axis of the plate. Mentioned channels 81 enclose transmission lines 31, 32, which may be coaxial transmission lines, connected to guiding means 70*a*, 70*b*, 70*c*, 70*d*, which may be strip guiding means, connecting the feeding termination points 50*a*, 50*b*, 50*c*, 50*d* to a feed network comprised in the antenna system. The feed network comprises all components necessary to feed the broadband antenna 10 with radio frequency, RF, signals of appropriate amplitudes and phases.

RF signals are coupled via a first pair of two separate radio signal guiding means 70*a*, 70*c* (e.g. strip lines or other suitable signal guides) to a first pair of two oppositely arranged slots 30*a*, 30*c*. The first pair of guiding means 70*a*, 70*c* comprises in this example of two strip lines of substantially equal electrical length. Similarly, a second pair of two separate radio signal guiding means 70*b*, 70*d* has substantially equal electrical length coupled to a second pair of oppositely arranged slots 30*b*, 30*d*.

FIG. 3 shows another embodiment. The embodiment in FIG. 3 has a support structure 80 with support arms 82 extending radially outwards from the center of the disc and being arranged to hold the conductive disc more securely over the reflector 8. Also in this case a first pair of guiding means 70*a*, 70*c* is connected to a first transmission line 31 at a point close to the center of the disc 20, and a second pair of guiding means 70*b*, 70*d* is connected to a second transmission line 32. The two transmission lines 30 and 32 are in turn connected to a feed network of the antenna system, via suitable radio signal guides arranged within channels of the support structure 80. The feed network is in this case located below the reflector 8 as shown in FIG. 3.

In the embodiment shown in FIG. 3, radio transmission guiding means 70*a*, 70*b*, 70*c*, 70*d* are in the form of microstrip lines positioned on top of a dielectric support layer 12*b*, and the radio frequency transmission lines 31, 32 are in the form of coaxial transmission lines arranged within channels of the support structure 80 and connected to the feed network. Further, in the embodiment shown in FIG. 3, the conductive disc 20 has the same size as the dielectric support layer 12*b*, but it is also possible to have a disc 20 that is larger than the dielectric support layer 12*b*.

Figure 5:
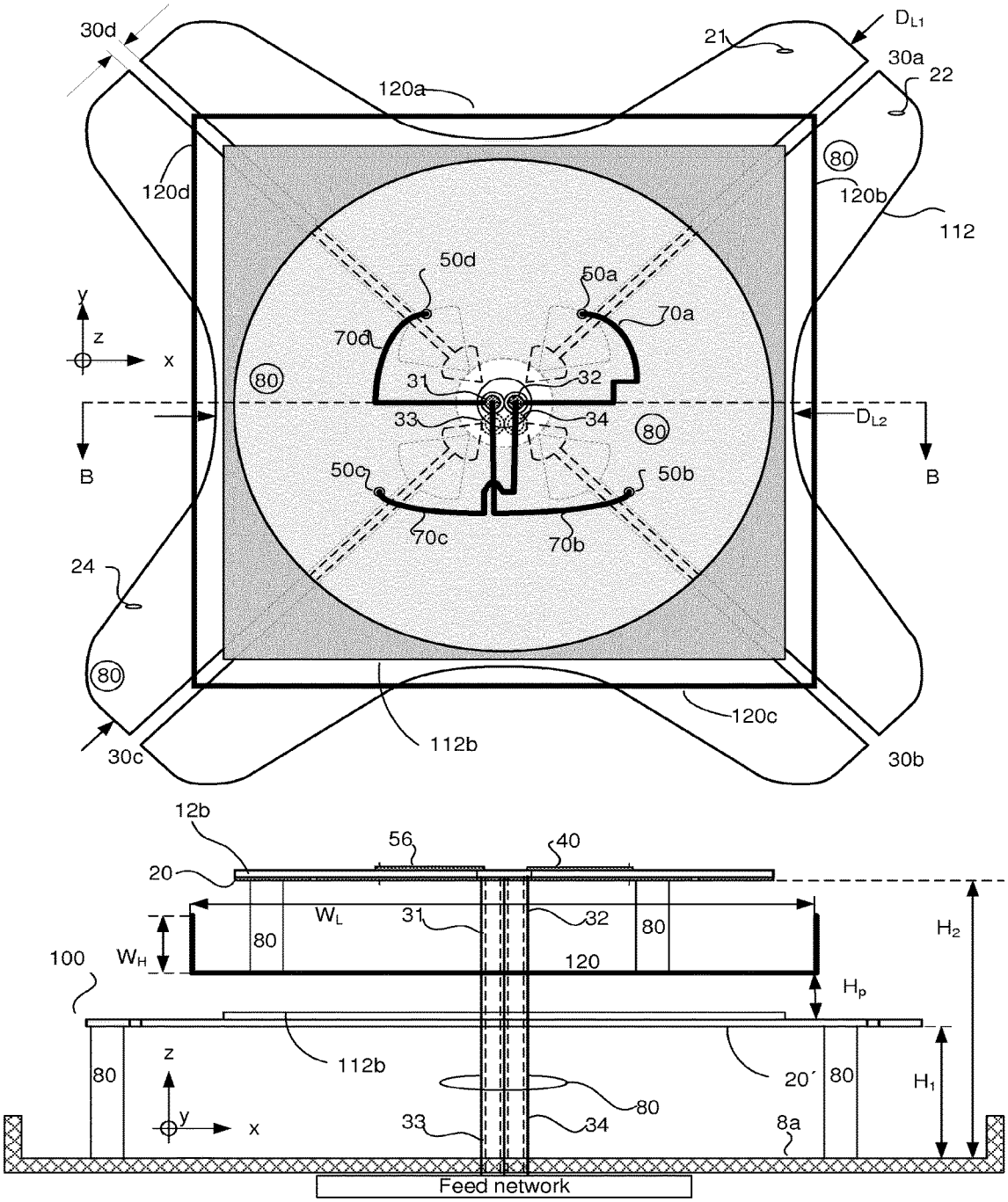
FIG. 5 shows top and side views of an antenna unit in which coaxial cables form a support structure.

According to one embodiment, the support structure 80 may be formed at least partly by coaxial transmission lines 31, 32, as they may contribute to spacing the discs. This is illustrated in FIG. 5. When coaxial transmission lines are used typically plastic stand-offs or similar is needed for fixing or further mechanically supporting the disc 20'. These plastic stand-offs are then considered to be components comprised in a distributed support structure 80 as disclosed in FIG. 5. The plastic stand-offs do not affect the electromagnetic field, and may therefore be placed independently of each other and/or other components of the antenna.

In other words, the stand-offs do not have to be e.g. arranged symmetrically.

It is preferable, but not necessary, to use different characteristic impedance for the strip lines 70*b*, 70*d* and the first transmission line 30 to avoid mismatch at the junction. For example, a characteristic impedance of 100 ohm for the strip lines 70*b*, 70*d* and a characteristic impedance of 50 ohm for the radio frequency guide 30. This choice minimizes the wave reflection at the junction between the strip lines 70*b*, 70*d* and the radio frequency guide 31.

Other choices of characteristic impedance are possible if this better matches the antenna impedance to the reference impedance of the antenna system. Analogous requirements apply to the other strip line structure of guiding means 70*a*, 70*c* and radio frequency guide 32.

Further, the first pair of guiding means 70*a*, 70*c* extends from the first radio frequency transmission line 31 over a first pair of oppositely arranged slots 30*a*, 30*c*, This will excite an electromagnetic field across the slots 30*a*, 30*c* which will propagate away from the antenna element 10 in a first linear polarization. The location of the feed points, defined by the second distance, R2, is where guiding means cross the slots, and affects the antenna impedance in such a way that a position closer to the rotational symmetry center of the disc, i.e. a smaller value for R2, will provide a lower resistance while a position further from the center of the disc 20 will increase the resistance. The electromagnetic field across the slots 30*b*, 30*d* may propagate away from the antenna element 10 in a second linear polarization, orthogonal to the first polarization.

Figure 4:
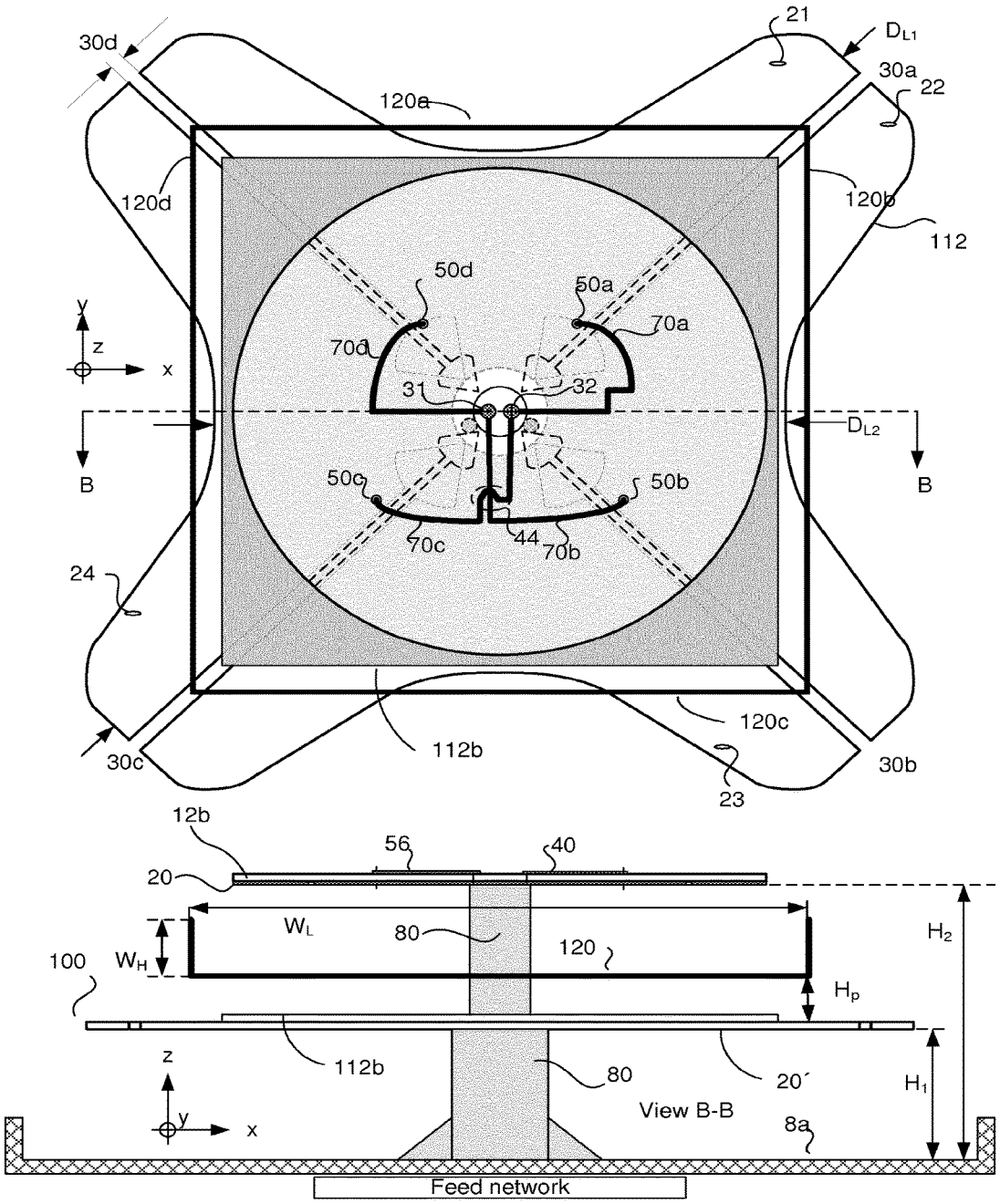
FIG. 4 shows top and side views of an antenna unit having antennas comprising symmetrically arranged cut outs it their respective slots.

In order to avoid intersection between different guiding means, if they are not insulated, which may be the case with microstrip lines, an air bridge 44 may be implemented, as illustrated in FIGS. 3, 4 and 5.

Furthermore, it is desirable to maintain the same length, and phase relationship, of respective pair of guiding means 70*a*, 70*c* and 70*b*, 70*d* which may be realized by adapting the length of individual guiding means, respectively.

An embodiment of a multiband antenna unit is shown in FIG. 4. The multiband antenna unit 200 comprises at least one first broadband antenna element 10 as described above and at least one second broadband antenna element 100 arranged above or below the first broadband antenna element 10 depending on the respective operating frequency of each antenna element 10, 100.

The antenna unit 200 may also comprise at least a first parasitic element 120 arranged between the first 10 and the second 100 broadband antenna elements. It should be noted that the parasitic element 120 is transparent in FIG. 4. The first parasitic element comprises a planar portion arranged in parallel with the plate comprised in the lower broadband antenna, and has a quadratic shape, The parasitic element may further have sidewalls protruding upwards in the main radiation propagation direction of the multiband antenna unit.

A second parasitic element may be arranged above the upper antenna. The second parasitic element may be arranged at a spacing from the upper antenna. The spacing, the size and the shape of the second parasitic element may be designed in relation to the properties of the upper antenna.

Preferably, the upper broadband antenna element 10 is arranged to radiate radio signals in a first frequency band f1 and the lower broadband antenna element 100 is arranged to radiate radio signals in a second frequency band f2. The center operation frequency of the first frequency band is higher than the center operation frequency of said second frequency band, and the lowest frequency of the highest frequency band is higher than the highest frequency of the lower frequency band.

The first and second elements together form a dual broadband antenna unit.

To control azimuth beamwidth of the above upper, higher frequency, antenna element 10 and the impedance of the below, lower frequency, element 100 a parasitic element 120 having four sides 120*a-d* is positioned at a distance above a conducting plate 112 of the antenna system as shown in FIG. 4. The parasitic element 120 will typically affect the impedance of the lower, frequency, antenna element and at the same time the radiation of the upper, higher frequency, antenna element acting as a reflector for the latter antenna element.

It is preferable that the width of the parasitic element 120 is greater than the size of the higher frequency antenna element, i.e. WL>2R1 The side dimension WL and wall height WH of the parasitic element 120 are chosen so as to achieve desired azimuth beamwidth for the first higher frequency antenna element. The parasitic element 120 can be constructed using suitable conductive materials, such as e.g. sheet metal.

Furthermore, the side dimension WL of the first parasitic element and the height HP above the conductive disc 20 is chosen to provide a good impedance match for the lower frequency antenna element. It has been noted that the first parasitic element 120 could have a length WL that is larger than ⅕ but less than ⅓ of a wavelength corresponding to a center operation frequency for the lower broadband antenna i.e. $\lambda cof/5<WL<\lambda cof/3$, for good performance.

A second parasitic element may be arranged above the top-most antenna. The second parasitic element may be smaller than the first parasitic element.

With reference to the embodiment of dual broadband antenna unit in FIG. 4 the dual broadband antenna unit 110 comprises a High Frequency Broadband Antenna Element HFBAE 10, previously described positioned above a corresponding Low Frequency Broadband Antenna Element, LFBAE, 100 having its dimensions scaled accordingly to provide effective operation in a desired frequency band generally lower in frequency than the frequency chosen for HFBAE operation. The LFBAE is constructed similarly to HFBAE previously described, The LFBAE consists of a conductive disc 20' positioned directly immediately underneath a dielectric support layer 112*b*. The conductive disc 20' can be made of a suitable metal disc cut from sheet metal, such as aluminum using any industrial process known to a skilled person.

Similarly to the HFBAE, the conductive disc 20' of the LFBAE is in this case divided into four quadrants 21', 22', 23', 24' (or leafs) by four slots 30*a*', 30*b*', 30*c*', 30*d*' with exception being that some portion of the metal leafs are not covered by dielectric support layer.

Complete coverage of metal leafs with dielectric support layer 112*b* may not be necessary for certain embodiments, and further adds expense. It has further been determined that leaf edges away from excitation slots 30*a*', 30*b*', 30*c*', 30*d*' can be cut out, scalloped, with a concave shape as this allows placement of the HFBAE nearby in a multiband antenna array (see also FIG. 5). Consequently, as is shown in FIG. 4, diagonal distance DL1 will be greater than scalloped, e.g. cut-out, cross distance DL2, without detrimentally effecting antenna element performance.

As disclosed in FIG. 4, the LFBAE element is positioned at distance H1 above reflector 8*a* (in a positive z-direction) and may be supported with an appropriately configured support structure 80. The support structure 80 is provided with two sets of radio frequency guides, with corresponding pairs feeding LFBAE and HFBAE radiators. The distance H1 may have relation to the height Hp as 2Hp<H1<6Hp according to an embodiment.

Even though a dual broadband antenna element structure has been described, the same designed principals can be applied to tri-band and more band antenna element units.

According to an embodiment, the lower antenna may be arranged to allow a transmission line pair 31, 32 destined for the upper antenna to extend from a feed network below the antenna unit through the plate of the lower antenna. The transmission lines of the pair of transmission lines may be coaxial transmission lines. In this embodiment, the lower antenna may be fed via a second pair of transmission lines 33, 34, as illustrated in FIG. 5.

Moreover, the specification also relates to an antenna array comprising a plurality of multiband antenna units 200 and a plurality of first broadband antenna elements 10. The present antenna array is configured such that the multiband antenna units 100 and the first broadband antenna elements 10 are alternately arranged in a row so that a distance between the center of a first antenna element 10 and an adjacent antenna unit 200 in the row is constant.

Figure 6:
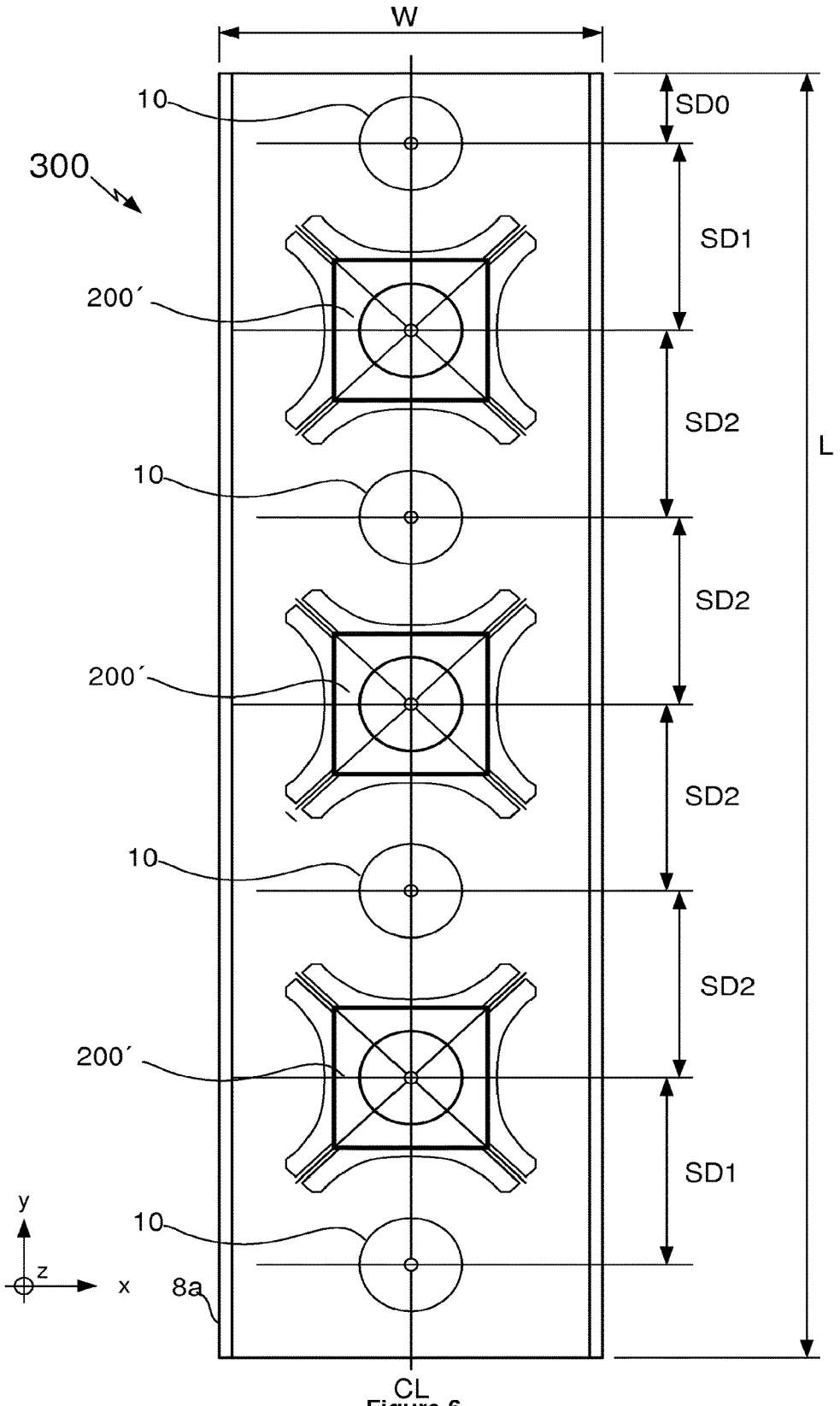
FIG. 6 shows an embodiment of an antenna array according to the present invention.

With reference to FIG. 6 an embodiment of a dual broadband antenna array 300 will be described. In this non-limiting example, three antenna units each comprising a LFBAE and a HFBAE 200', and four HFBAEs 10 are arranged alternately in a row, along the Y-axis, i.e. along longitudinal center line CL of the reflector 8*a*. Dimensions SD1 and SD2 are preferably equal so that the high frequency array has uniform spacing throughout the array. The distance SD0 is chosen based on the total length acceptable for the antenna and if possible set to a value near SD1. As well known to those skilled in the art, the dimensions SD1 and SD2 have to be chosen less than 1 wavelength to avoid the presence of multiple maxima, or grating lobes, in the vertical pattern. If the main beam of the antenna array is steered away from the horizontal plane, the distance has to be even smaller and a distance of 0.5 wavelengths will guarantee that there are no grating lobes for any steering angle. In practice, it is difficult to fit the antenna elements with such a small spacing and it was found that a value SD1=SD2=112 mm provides good performance for operation in the lower band 790-960 MHz and the higher band 17 10-2690 MHz (as an example). In the lower frequency band, we thus have an array spacing of 224 mm, or 0.65 wavelengths at the center frequency 875 MHz. In the higher frequency band, the spacing is 112 mm, or 0.82 wavelengths at the center frequency 2200 MHz.

As can be readily understood by the skilled person, the above described antenna array may be incorporated in a broadband antenna system. It is also realized that a broadband antenna system may incorporate any combination of antenna elements and antenna units.

The broadband antenna system is preferably adapted for transmitting and/or receiving radio transmission signals for wireless communication systems such as GSM, GPRS, EDGE, UMTS, LTE, LTE-Advanced, and WiMax systems.

The person skilled in the art realizes that the embodiments described above are exemplary embodiments, rather than an exhaustive list of embodiments. Many modifications and variations are possible within the scope of the appended claims.

Additionally, variations to the disclosed embodiments can be understood and effected by the skilled person, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

I claim:

1. A multiband antenna unit, comprising at least one first broadband antenna and at least one second broadband antenna arranged above or below said first broadband antenna; and further comprising at least one planar parasitic element arranged between said first and second broadband antennas, said first broadband antenna comprising:

a conductive plate, said plate comprising four slots arranged in a rotation symmetrical manner in said plate, each slot of the said four slots extending from a circumference of said plate towards a rotational symmetry center of the plate;

four guiding means, each guiding means connected to the plate in one feeding termination point associated with one slot of the four slots;

wherein:

a first pair of the feeding termination points is associated with a first pair of oppositely arranged slots of the said four slots;

a second pair of the feeding termination points is associated with a second pair of oppositely arranged slots of the said slots; and the feeding termination points is arranged on a same surface of the plate such that:

a first feeding termination point of each said pair of feeding termination points is offset from its associated slot in a first circumferential direction; and a second feeding termination point of each said pair of feeding termination points is offset from its associated slot in a circumferential direction that is opposite to the said first circumferential direction.

2. The multiband antenna unit according to claim 1, wherein the two guiding means connected to the first pair of feeding termination points are of substantially equal electrical length.

3. The multiband antenna unit according to claim 2, wherein the two guiding means connected to the second pair of feeding termination points are of substantially equal electrical length.

4. The multiband antenna unit according to claim 1, wherein:

said circumference is located at a first distance (R1) from the said rotational symmetry center;

each feeding termination point is located at a second distance (R2) from the rotational symmetry center; and the second distance (R2) is less than said first distance (R1).

5. The multiband antenna unit according to claim 4, wherein said second distance (R2) is less than 0.5 times the first distance (R1).

6. The multiband antenna unit according to claim 4, wherein each slot ends at a fourth distance (R4) from the rotational symmetry center, the fourth distance (R4) being less than the second distance (R2).

7. The multiband antenna unit according to claim 1, further comprising a conducting reflector arranged offset from the conductive plate, in a direction perpendicular to the surface of the plate.

8. The multiband antenna unit according to claim 7 further comprising a support structure arranged to hold said conductive plate over the reflector structure.

9. The multiband antenna unit according to claim 8, wherein the support structure is a distributed support structure comprising a plastic stand-off that further mechanically supports the conductive plate.

10. The multiband antenna unit according to claim 1, wherein the circumference of the plate is shaped in a rotational symmetrical manner.

11. The multiband antenna unit according to claim 1, wherein an edge of the plate has concave cut-outs, each cut-out being arranged between two neighboring slots.

12. The multiband antenna unit according to claim 1, wherein said parasitic element comprises a planar portion arranged in parallel with the plate comprised in the lower broadband antenna, and has a quadratic shape.

13. The multiband antenna unit according to claim 12, wherein the width (WL) of the quadratic shape of the parasitic element is larger than ⅕ but less than ⅓ of a wavelength corresponding to a center operation frequency for the lower broadband antenna.

14. The multiband antenna unit according to claim 1, wherein the upper broadband antenna is arranged to radiate radio signals in a first frequency band (f1) and the lower broadband antenna is arranged to radiate radio signals in a second frequency band (f2), the center operation frequency of said first frequency band (f1) being higher than the center operation frequency of said second frequency band (f2).

15. The multiband antenna unit according to claim 1, further comprising a second parasitic element arranged above the upper antenna.

16. The multiband antenna unit according to claim 1, wherein the said second broadband antenna is constructed similarly to the said first broadband antenna.

17. An antenna array comprising a plurality of multiband antenna units of claim 1.

18. The antenna array according to claim 17, further comprising a plurality of broadband antennas, wherein the plurality of multiband antenna units and the plurality of broadband antennas are alternately arranged in a row.

19. A method comprising:

providing a multiband antenna unit of claim 1;

feeding a first radio frequency, RF, signal to the said first pair of feeding termination points of the said first broadband antenna, thereby feeding the first pair of oppositely arranged slots in phase; and feeding a second RF signal to the said second pair of feeding termination points of the said first broadband antenna, thereby feeding the second pair of oppositely arranged slots in phase.

20. The method according to claim 19, further comprising:

coupling the fed first RF signal to the first pair of feeding termination points via a first and second separate guiding means, said first and second guiding means being of substantially equal electrical length;

coupling the fed second RF signal to the second pair of feeding termination points via a third and fourth separate guiding means, said third and fourth guiding means being of substantially equal electrical length.

21. The method according to claim 19, wherein the multiband antenna unit is comprised in an antenna array.

22. The method according to claim 21, wherein the antenna array comprises a plurality of multiband antenna units and a plurality of broadband antennas alternately arranged in a row.

* * * * *